US006462663B1

(12) United States Patent
Wilson et al.

(10) Patent No.: US 6,462,663 B1
(45) Date of Patent: Oct. 8, 2002

(54) USE OF DETECTOR ARRAYS TO DETECT CESSATION OF MOTION

(75) Inventors: Bryan Lorrain Humphreys Wilson, Northants (GB); Stephen Hollock, Lechlade (GB); Stephen George Porter, Northants (GB)

(73) Assignee: Infrared Integrated Systems, Ltd., Northants (GB)

( * ) Notice: Subject to any disclaimer, the term of this patent is extended or adjusted under 35 U.S.C. 154(b) by 0 days.

(21) Appl. No.: 09/447,600

(22) Filed: Nov. 22, 1999

(30) Foreign Application Priority Data

Nov. 26, 1998 (GB) ..... 9825976

(51) Int. Cl.[7] ..... G08B 23/00

(52) U.S. Cl. ..... 340/573.1; 250/342; 250/DIG. 1; 340/529; 340/567

(58) Field of Search ..... 340/573.1, 567, 340/541, 309.15, 529; 250/342, DIG. 1; 348/143, 152, 153

(56) References Cited

U.S. PATENT DOCUMENTS

| | | | | | |
|---|---|---|---|---|---|
| 3,631,434 A | * | 12/1971 | Schwartz | ..... | 340/567 |
| 4,249,207 A | * | 2/1981 | Harman et al. | ..... | 348/152 |
| 4,286,331 A | * | 8/1981 | Anderson et al. | ..... | 340/541 |
| 5,283,551 A | * | 2/1994 | Guscott | ..... | 340/567 |
| 5,386,210 A | * | 1/1995 | Lee | ..... | 340/567 |
| 5,602,585 A | * | 2/1997 | Dickinson et al. | ..... | 348/152 X |
| 5,726,449 A | * | 3/1998 | Yoshiike et al. | ..... | 340/567 X |
| 5,905,436 A | * | 5/1999 | Dwight et al. | ..... | 340/573.1 |

FOREIGN PATENT DOCUMENTS

| | | | | |
|---|---|---|---|---|
| GB | 0481934 | | 4/1992 | ..... G08B/29/04 |
| GB | 0499177 | | 8/1992 | ..... G08B/29/04 |
| GB | 0556898 | | 8/1993 | ..... G08B/29/04 |
| GB | 2 344 167 | * | 5/2000 | |
| NZ | 270882 | | 4/1995 | |
| WO | 9420939 | | 3/1994 | ..... G08B/21/00 |

* cited by examiner

*Primary Examiner*—Thomas Mullen
(74) *Attorney, Agent, or Firm*—Malin, Haley & DiMaggio, P.A.

(57) ABSTRACT

A sensor comprising an array of detectors for e.g. infrared radiation of the type for use in security or surveillance application has means for identifying the entry of an object into a first selected area of a scene and means for generating a warning or alarm signal after a first predetermined period of time during which there is no movement of the body within the first selected area.

8 Claims, 3 Drawing Sheets

USE OF DETECTOR ARRAYS TO DETECT CESSATION OF MOTION

TECHNICAL FIELD OF THE INVENTION

The present invention relates to a sensor comprising an array of detectors and in particular the invention relates to a sensor of this type for use in security or surveillance applications.

DESCRIPTION OF BACKGROUND ART

Presently available sensors for use in security or surveillance generally fall into two categories. There are simple passive sensors such as passive infrared sensors which detect movement of objects and generate corresponding warning or alarm signals and there are more complex surveillance devices such as closed circuit television cameras which employ a multiplicity of detector elements to provide an image of the scene being monitored.

The present invention is based on the realisation that it would be useful to detect the absence of movement of objects such as a person falling asleep when it is necessary that they are alert and mobile or a person not getting up after a fall.

BRIEF SUMMARY OF THE INVENTION

The invention provides a sensor comprising a linear or two-dimensional array of detectors, optical collection means arranged so that spatial information from a scene is focused onto the array, read out means for monitoring signals from the detectors, means responsive to the said signals for identifying the entry of an object into a first selected area of the scene and means for generating a warning or alarm signal after a first predetermined period of time during which there is no movement of the body within the first selected area.

The selected area could be the entire scene which is focused onto the array, but it is more likely that it would be part of the scene. The size of the object could be such that it occupies any part of the scene and consequently any number of elements of the array image.

The sensor of the invention would be particularly useful for example in a security environment where it could be used to detect when an object has been moved in front of the sensor such that it obscures the field of view of the sensor; an alarm could be raised if the field of view remains obscured for more than a predetermined length of time. It would also be particularly useful, for example, at the home of an elderly or infirm person; in this case it could be used to detect the person falling over and not getting up again or to detect a person sitting in a chair or lying on a bed for an unusually long period of time. Thus a sensor according to the invention could be used to survey an area in the home including the person's bed; it could detect the person going to bed and raise the alarm if the person is still on the bed, motionless, after a predetermined length of time.

A sensor according to the invention could be used to raise an alarm after no movement has been detected in a number of different locations within the scene. Thus, the preferred sensor according to the invention includes means for identifying the entry of an object into a second area of the scene and means for generating a warning signal after a second predetermined period of time during which there is no movement of the object within the second selected area. The second period of time may be different from the first period of time. In fact, the number of different selected areas monitored by the sensor according to the invention may be more than two and each area may have a different allocated predetermined period of time. Thus, for example, a sensor according to the invention could be programmed to give a warning or alarm after, say, 8 hours on the bed, 3 hours on the armchair or 10 minutes on the floor, the latter being to detect a person who has fallen over and not got up again. The sensor according to the invention can, of course, also be used to detect intruders if programmed accordingly.

A sensor according to the invention might be provided with a means for programming 'in situ' according to the layout of the particular space being monitored, or it may have the capability of self-learning.

An embodiment of the invention will now be described by way of example only and with reference to the accompanying drawings in which:

DESCRIPTION OF THE PREFERRED EMBODIMENTS

Figure 3:
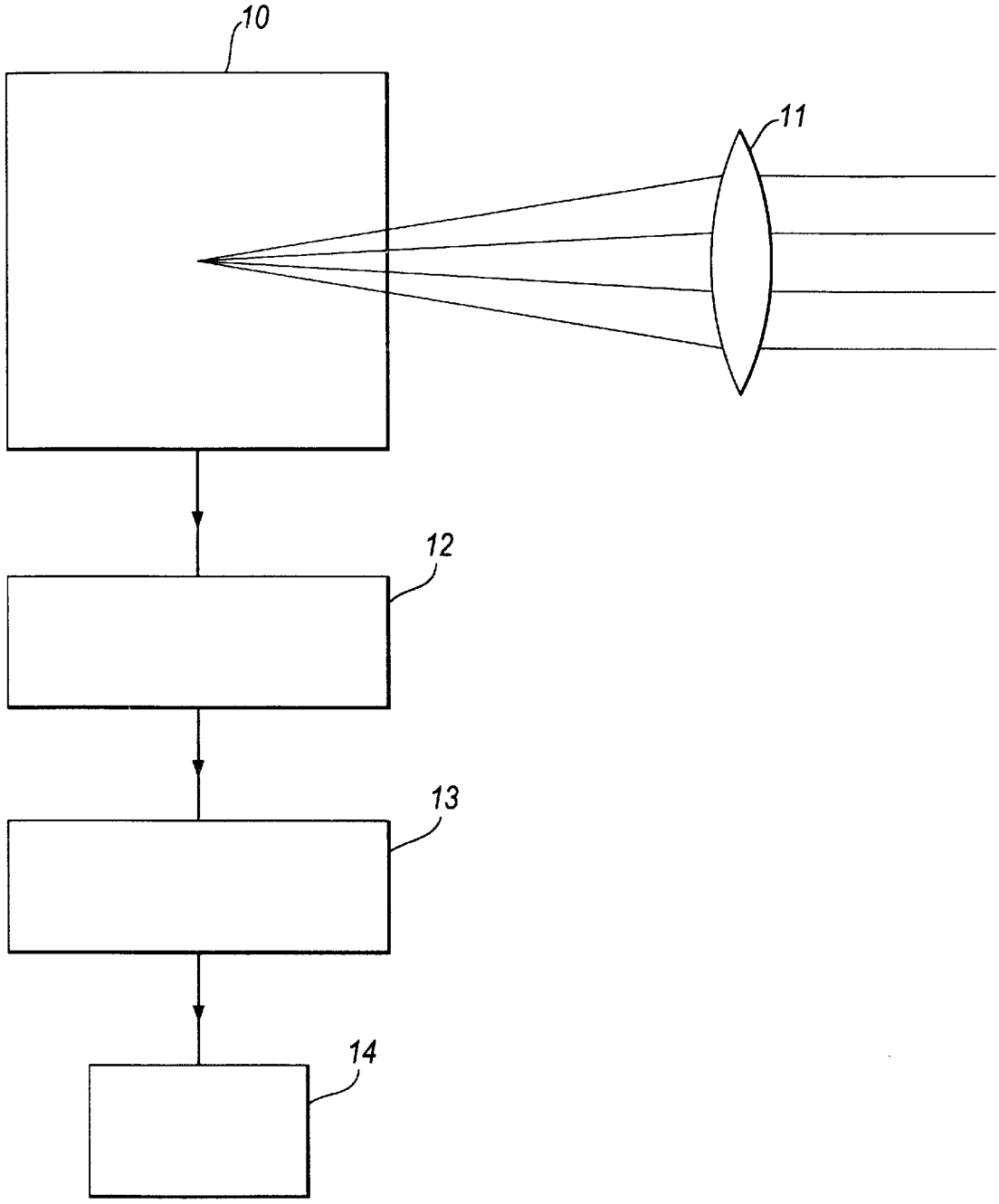
FIG. 3 is a schematic diagram illustrating the sensor and the associated optical collection means, readout means and other processing circuitry.

The sensor 10 of the invention is installed to monitor a room 30 whose contents include a bed 31, a chair 32 and a fireplace 33. The sensor 10 is made up of a two dimensional array of 16×16 infrared sensitive detector elements 1A to 16P, preferably pyroelectric detectors, together with an optical lens 11 or mirror arrangement (not shown) which focuses an image of the room 30 onto the detector array 10. The sensor has readout means schematically indicated at 12 in FIG. 3 for monitoring signals from the detectors, means 13 responsive to the signals for identifying the entry of an object into a first selected area of the scene and alarm means 14 for generating an alarm or warning signal in the manner to be described. The sensor also incorporates processing capabilities which enable it to be either pre-programmed or programmed in situ to recognise human beings and to discriminate against false alarm sources such as pets, sunlight, moving curtains etc. It is also programmed to know the location within the scene of the important features such as the door 34, the bed 31 etc.

As the infrared detector elements 1A–16P will enable the sensor to detect the entry of a person into the room 30, this feature is used at some times of the day, (e.g when the room is unoccupied) to detect an intruder or intruders; at other times the person or persons within the room are monitored as to their position within the room 30 and their time in any particular location therein. In this example the person or persons are monitored as they move around the room, and the arrival times in any particular locations are recorded. Consequently when a person sits on the chair 32 or lies on the bed 31, the time is recorded, and the elapsed time compared with the predefined limits for each location. If the elapsed time exceeds the limit and the person has not moved, a warning is given or an alarm sounded. The time limits for the various locations, eg. bed, chair, floor etc. can be reset to new values which are determined by the changing environment, circumstances, person etc. It is possible that a multiplicity of sensors could be deployed within the home; different time settings may be used in different locations.

Figure 1:
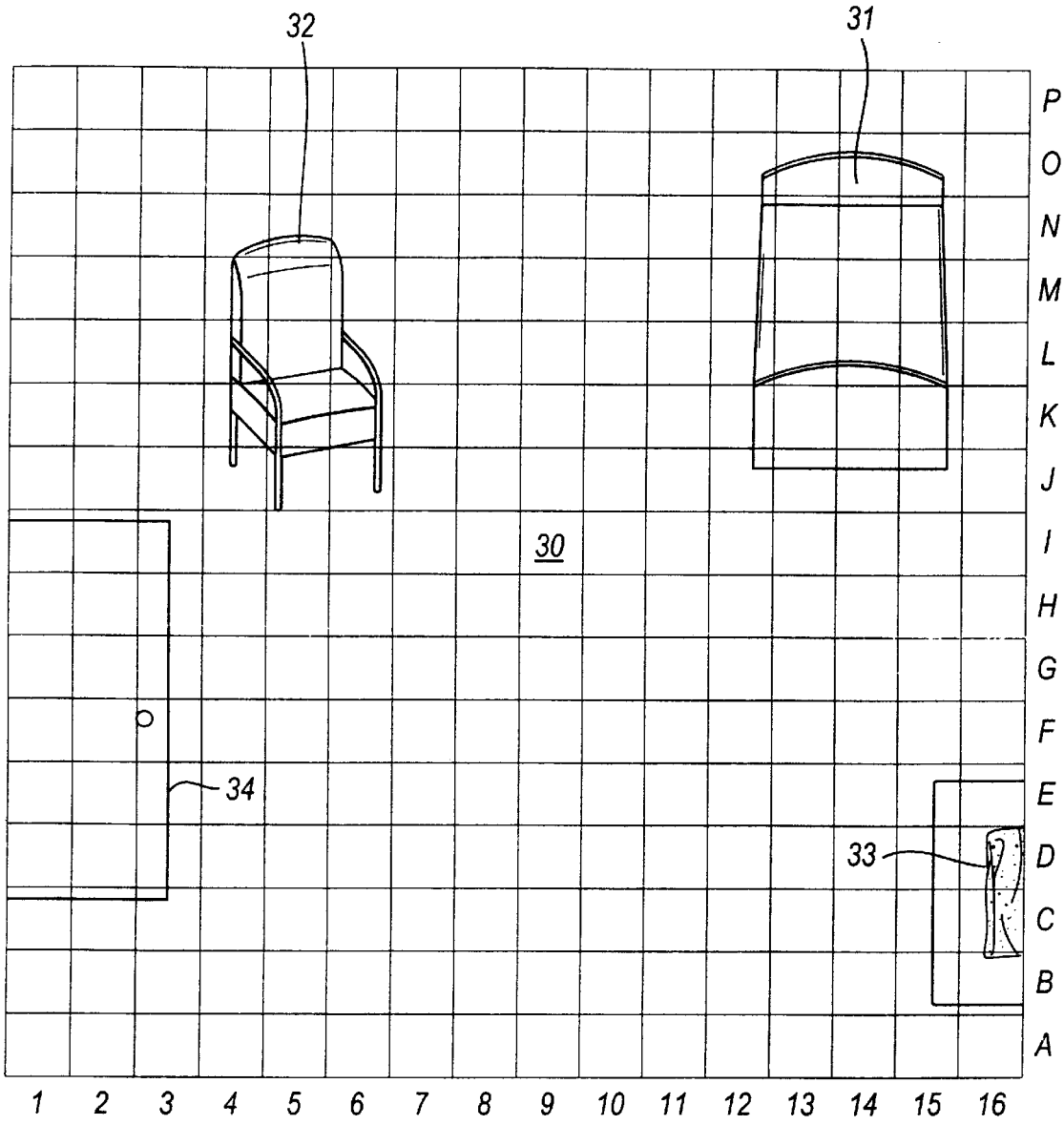
FIG. 1 shows a scene as viewed by a 16×16 array of detectors.
Figure 2:
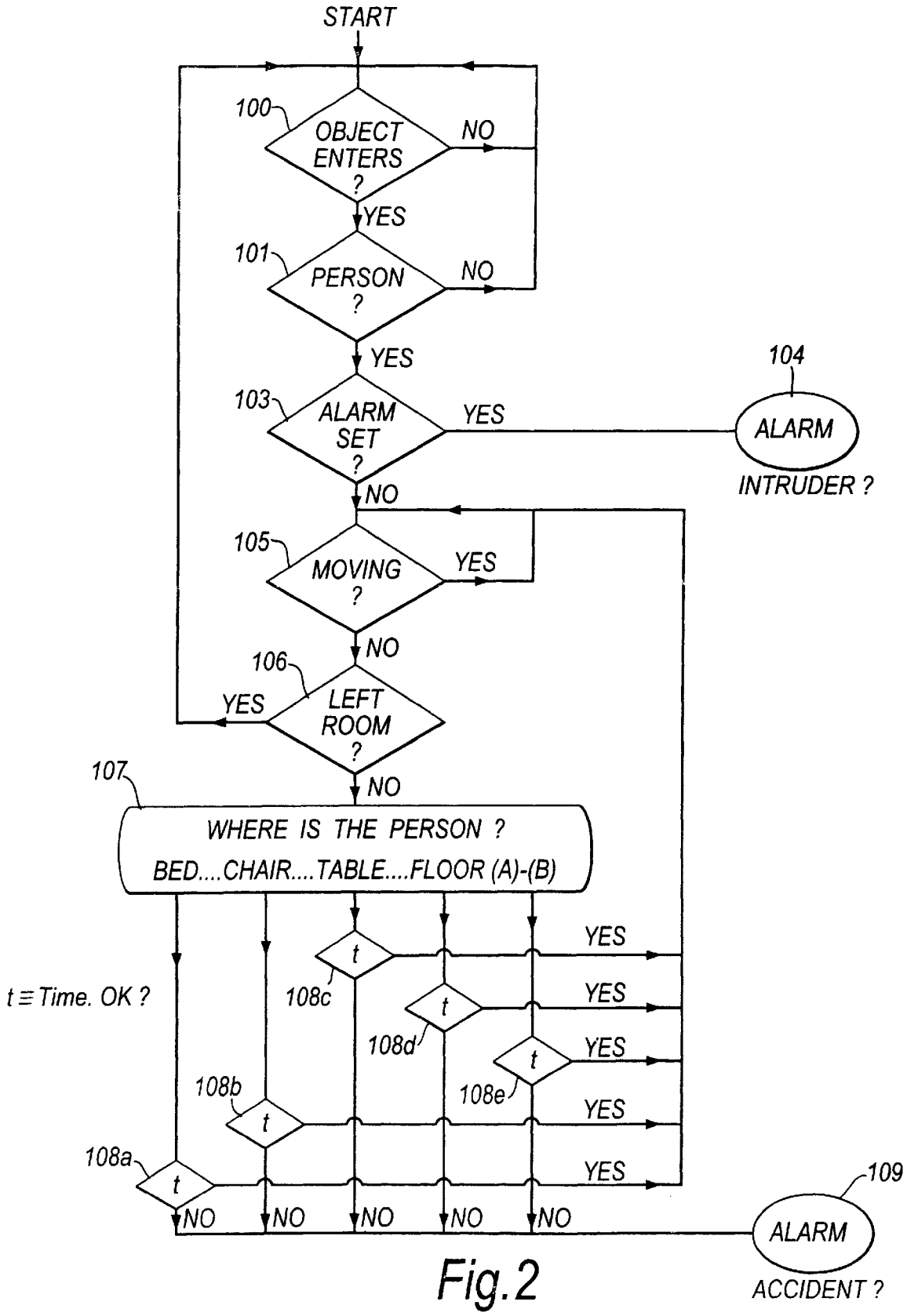
FIG. 2 is a flow chart illustrating the operation of a sensor incorporating the array of FIG. 1.

The operation of the sensor in this example is illustrated by the flow chart of FIG. 2.

The detectors 1A–16P are continually monitored, at step 100, in order to determine whether an object has entered the field of view of the sensor. If an object is detected, a determination is made at step 101 whether or not the object is a person. In the affirmative, a check is made at step 103 whether the sensor has been programmed to act as an intruder alarm and if the affirmative, the alarm sounds at step 104.

If the sensor is not to act as an intruder alarm, step 105 determines whether the person is moving. If not, the person may have left the room and this is checked at step 106. This may be achieved by following the person's movements or monitoring the door.

At step 107 the person is located within the room and a timer commences at steps 108*a, b, c, d, e*, depending on the location of the person. When the set time has elapsed without the person moving, an alarm sounds at step 109.

What is claimed is:

1. A sensor comprising a two-dimensional array of detectors, optical collection means arranged so that the spatial information from the scene is focused onto the array, read-out means for monitoring signals from the detectors of the array, means responsive to said readout means for identifying the entry of an object into first selected area of the scene and means for generating a warning signal after a first predetermined period of time during which there is no movement of the object within or near to the first selected area.

2. A sensor as claimed in claim 1 in which the selected area is a part of the scene.

3. A sensor as claimed in claim 1 or claim 2 including means for identifying the entry of an object into one or more other selected areas of the scene and means for generating a warning signal after a predetermined period of time particular to each area during which there is no movement of an identified object within or near to a selected area.

4. A sensor as claimed in claim 3 in which at least two of the periods of time are different in duration from each other.

5. A sensor as claimed in claim 1 including means for identifying the entry of a second or subsequent object into any selected area of the scene and means for generating a warning signal after the predetermined period of time particular to that area during which there is no movement of an identified object within or near to that area.

6. A sensor as claimed in claim 1 in which the detectors are sensitive to infrared radiation.

7. A sensor as claimed in claim 1 in which the detectors are pyroelectric detectors.

8. A sensor as claimed in claim 1 in which the identifying means is adapted to distinguish human beings from other objects.

* * * * *